US006222166B1

(12) United States Patent
Lin et al.

(10) Patent No.: US 6,222,166 B1
(45) Date of Patent: Apr. 24, 2001

(54) ALUMINUM SUBSTRATE THICK FILM HEATER

(75) Inventors: Hongy Lin, Chesterfield; Thomas Laskowski, Pacific, both of MO (US)

(73) Assignee: Watlow Electric Manufacturing Co., St. Louis, MO (US)

( * ) Notice: Subject to any disclaimer, the term of this patent is extended or adjusted under 35 U.S.C. 154(b) by 0 days.

(21) Appl. No.: 09/371,187

(22) Filed: Aug. 9, 1999

(51) Int. Cl.[7] ..... H05B 3/02

(52) U.S. Cl. ..... 219/538; 219/548; 219/553

(58) Field of Search ..... 219/443.1, 528, 219/534, 538, 543, 544, 548, 553; 392/434, 438; 338/223, 224, 238, 243

(56) References Cited

U.S. PATENT DOCUMENTS

| | | | | |
|---|---|---|---|---|
| 3,425,864 | | 2/1969 | Morey | 117/215 |
| 3,968,347 | | 7/1976 | Isoard | 219/530 |
| 4,032,751 | * | 6/1977 | Youtsey et al. | 219/538 |
| 4,280,046 | * | 7/1981 | Shimotori et al. | 219/544 |
| 4,310,745 | * | 1/1982 | Bender | 219/538 |
| 4,498,071 | * | 2/1985 | Plough, Jr. et al. | 219/548 |
| 4,697,165 | * | 9/1987 | Ishiguro et al. | 219/538 |
| 4,713,530 | * | 12/1987 | Schittenhelm et al. | 219/543 |
| 4,724,305 | | 2/1988 | Iimura et al. | 219/469 |
| 4,776,070 | | 10/1988 | Shibata et al. | 29/130 |
| 4,808,490 | | 2/1989 | Tsukuda et al. | 428/699 |
| 4,813,372 | | 3/1989 | Kogure et al. | 118/60 |
| 4,860,434 | * | 8/1989 | Louison et al. | 219/548 |
| 5,344,696 | * | 9/1994 | Hastings et al. | 219/548 |
| 5,408,070 | * | 4/1995 | Hyllberg | 219/548 |
| 5,414,245 | * | 5/1995 | Hackleman | 219/548 |
| 5,434,388 | * | 7/1995 | Kralik et al. | 219/538 |
| 5,600,414 | | 2/1997 | Hyllberg | 399/176 |
| 5,616,263 | | 4/1997 | Hyllberg | 219/469 |
| 5,643,483 | * | 7/1997 | Kubota et al. | 219/543 |
| 5,665,262 | | 9/1997 | Hajaligol et al. | 219/553 |
| 5,705,272 | * | 1/1998 | Taniguchi | 219/548 |
| 5,822,675 | * | 10/1998 | Paquet et al. | 219/548 |
| 5,841,111 | * | 11/1998 | Shea et al. | 219/548 |
| 5,928,547 | * | 7/1999 | Shea et al. | 219/548 |

* cited by examiner

*Primary Examiner*—Teresa Walberg
*Assistant Examiner*—Fadi H. Dahbour
(74) *Attorney, Agent, or Firm*—Blumenfeld, Kaplan & Sandweiss, P.C.

(57) ABSTRACT

Thick film resistive element heater with an aluminum substrate having a ceramic oxide dielectric insulator there between.

19 Claims, 1 Drawing Sheet

ALUMINUM SUBSTRATE THICK FILM HEATER

BACKGROUND OF THE INVENTION

1. Field of the Invention

This invention relates to thick film resistive element heaters and more specifically to a thick film heater with a metal substrate where the metal has a high coefficient of thermal expansion such as aluminum.

2. Related Art

As used herein, "Thick Film" means a metal based paste containing an organic binder and solvent, such as ESL 590 ink, manufactured by Electro-Science Laboratories, Inc., Philadelphia, Pa. ("ESL"). "Ceramic Oxide" means a refractory type ceramic having a high content of oxidized metal; "MPa" means mega Pascals (large units of Pressure); "Coefficient of thermal expansion ($10E^{-6}$/° C.)" (CTE) means micro-units of length over units of length per ° C. or parts per million per ° C.; and "W/m·K" means watts per meter kelvin (units of thermal conductivity). High expansion metal substrates means ferrous or non-ferrous metal having a CTE of $16\times10E^{-6}$/° C. or higher.

Thick film resistive element heaters are relatively thick layers of a resistive metal based film as compared to "thin film" technology (1–2 orders of magnitude thinner than thick film) and is typically applied to a glass based dielectric insulator layer on a metal substrate when used as a heater.

Heaters having a body or substrate made of a metal with a CTE of greater than $16\times10E^{-6}$/° C. such as high purity aluminum or high expansion stainless steel are desirable. This is because aluminum or other like metals have excellent thermal conductivity properties which makes it an ideal substrate or body for heaters requiring extraordinarily uniform temperature distribution. However, for metals that have excellent thermal conductivity and uniform heat distribution characteristics, as noted, it is also not unusual for these metals to have higher CTEs like aluminum. Conventionally, aluminum heaters are made by embedding a coil heating element inside an aluminum cast or by putting a foil heater beneath an aluminum plate with an insulation material such as a mica plate in between. Aluminum heaters of this type can have a thinner profile than comparably rated heaters made of steel. The thinner profile is achievable while maintaining the desired heater performance because of the high thermal conductivity of aluminum which is 10–20 times higher than standard 400 series stainless steel. However, as in the case of aluminum, there is also a high CTE.

The profile of the heater can be reduced even further if the heater comprises a metal substrate with a "thick film" heating element applied to the substrate because thick film technology allows precise deposition of the heating element at an exact location where heat is needed and intimate contact of the heating element to the substrate which eliminates any air gap there between. Another benefit of using thick film is that there is a greater flexibility of circuit designs to better achieve uniformity in temperature distribution and to provide precision delivery of heat for better control and energy savings. Also, thick film resistive elements can be made to conform to various contoured surfaces required for specific custom applications.

Thick film heaters are typically applied on top of a glass dielectric material that has already been applied on the metal substrate. It is desirable to utilize a glass dielectric in combination with thick film technology because glass based materials provide a very flat and smooth electrically insulated surface layer, glass materials are not porous, and are not moisture absorbing. These characteristics of glass materials allow the thick film to be applied easily while achieving the desired trace pattern and with the correct height or elevation and width of the trace.

Thick film heating elements are desired because thick film can offer uniform temperature distribution because of the flexibility to form various small or intricate heating element trace pattern designs. Therefore, a thick film on an aluminum substrate would be very useful if it could be made to work because of aluminum's thermal performance characteristics. So far the prior art teaches the use of a glass based dielectric when using thick film over a metal substrate, but that will not work when using aluminum as the substrate metal or other metals having a high CTE relative to the typical glass dielectric utilized with thick film. Therefore, even though the thermal performance of aluminum is desirable, the high CTE is not compatible with a glass based dielectric. As seen in industry, thick film heaters on metal substrates use glass dielectric material to serve as an insulation between the thick film and the metal substrate, usually 400 series stainless steel which has a CTE of $12\times10E^{-6}$/° C. The reason why aluminum or other higher CTE metals are problematic is aluminum has a much higher thermal expansion coefficient than glass used for 400 series stainless steel and therefore causes cracking in the glass dielectric material when heating or cooling occurs. The cracking causes opens in the resistive heating film resulting in a defective heater. Cracking typically occurs when the aluminum substrate is cooling down and contracting after the temperature has been raised. A second problem is that the typical printing method for applying such a dielectric is screen printing which requires a firing post-process for the curing of the dielectric. The melting point of aluminum is about 600° C. Therefore, if a glass dielectric is utilized, it must have a lower melting point than 600° C. in order to be properly fired for adequate curing. A glass having a low melting point of 600° C. can be found, but the final heater design will be limited to a low operating temperature (below 400° C.). This is because the softening temperature of a glass dielectric is usually 200° C. or more lower than the melting temperature (hypothetically 600° C. —in order to work with aluminum). Also, when glass reaches its transition temperature, which is 50–100° C. below the softening temperature, the glass will significantly loose its insulation resistance properties. Therefore, just above the softening temperature, the glass will significantly loose its insulation resistance properties, so the heater is limited to temperatures below 300° C. This renders an aluminum-glass heater design useless for many applications. In addition, the dielectric cracking problem is not resolved by choosing a glass dielectric with a lower melting point. A third problem is that if a glass with a lower melting point is chosen then the firing temperature to cure the thick film element applied on top of the dielectric is limited to that of the glass. Therefore a special thick film must be found that has a lower curing or sintering temperature.

The above problems have prevented the use of thick film heater elements on aluminum substrates because, even if a thick film with a lower melting point (lower than the melting point of the glass dielectric chosen) is found and utilized, the resulting operating temperature of the heater would be useless for many operating temperatures and the dielectric cracking problem is still not resolved because the difference in the coefficient of thermal expansion still exists. Also, a glass based dielectric with such a low melting point will have poor insulation performance at the higher operating temperatures and insulation breakdown is likely.

Conventional wisdom then is that aluminum or other higher CTE metals like high expansion stainless steel is simply an incompatible substrate for thick film heaters.

SUMMARY OF THE INVENTION

It is in view of the above problems that the present invention was developed.

The invention thus has as an object to provide a thick film resistive heating element disposed on an aluminum substrate or substrate of a higher CTE metal relative to the CTE of the typical glass based dielectric utilized with thick film by interposing an alumina dielectric, or other comparable ceramic oxide, insulator there between.

It is another object to provide more efficient heating in a thick film heater.

It is also an object to provide better temperature control capability for thick film heaters.

It is yet another object to provide a faster responding thick film heater.

It is a further object to provide a more uniform surface temperature distribution for thick film heaters.

It is a still further object to eliminate the glass dielectric so as to not be limited by the low melting or processing temperature of the glass dielectric.

The invention has solved the puzzle posed by the prior art and satisfies all the above objects by providing a method and apparatus for a thick film heater utilizing an aluminum substrate or a substrate made of metals having a CTE of greater than $16\times10E^{-6}/°$ C. which were previously known to be incompatible with thick film technology. The inventors have gone against conventional wisdom and by doing so have found a resolution to the problems outlined above. The inventors have developed an aluminum substrate heater with a refractory ceramic oxide dielectric, such as alumina, applied with a thermal bonding process such as a plasma spray process whereby firing is not required to cure or densify the dielectric and a thick film resistive trace heating element applied on the dielectric. The elimination of firing is a major advance allowing much more flexibility in design of the thick film. In addition, even when the thick film resistive trace is fired, the alumina or other ceramic oxide material can withstand the temperature shock and the expansions and contractions of aluminum. The same holds true when the heater is in normal operation. This heater is expected to be a key breakthrough in thick film heater design.

The inventor has also discovered that if the glass based insulative over glaze top layer that is typically applied over thick film resistive element heaters, is replaced by a ceramic oxide over coat insulative top layer, the heater performance at the upper temperature range is improved. The improved performance is due to better high temperature performance characteristics of ceramic oxides such as high melting point, insulation resistance, rigidity and fracture strength.

The inventor has theoretically and empirically determined that alumina and other ceramic oxides with similar properties can withstand the temperature shock when the thick film is fired and can withstand the contractions and expansions of an aluminum substrate or other higher CTE metals during normal usage.

It should be noted that choosing a metal that has superior thermal performance parameters is only one of many reasons why a metal is chosen for a heater design. A metal may also be chosen because of its compatibility with the environment in which it is to operate or because of some other charateristic that makes it the preferred metal. However, the preferred metal may also happen to have a higher CTE relative to the typical glass based dielectric utilized with thick film technology. Therefore, the heater designer may have to rule out the preferred metal because the designer also desires to utilize a thick film heater element because of the desired profile of the heater and/or because of the surface on which the heater element must be applied. The designer in such circumstances is forced to make a design decision as to which is most important, utilization of thick film or the preferred metal.

This is then a key breakthrough that will open the door to numerous subsequent advances in thick film heater design and because of that will lead to many advances in the design of small heater parts in many future devices.

It was discovered, as part of the invention, that greater temperature control and thermal efficiency can be achieved with the use of an aluminum substrate as compared to stainless steel.

It was also discovered that a glass based dielectric for a thick film heater on a metal substrate is not the only option.

BRIEF DESCRIPTION OF THE DRAWING

The advantages of this invention will be better understood by referring to the accompanying drawing, in which.

DESCRIPTION OF THE INVENTION

Figure 1:
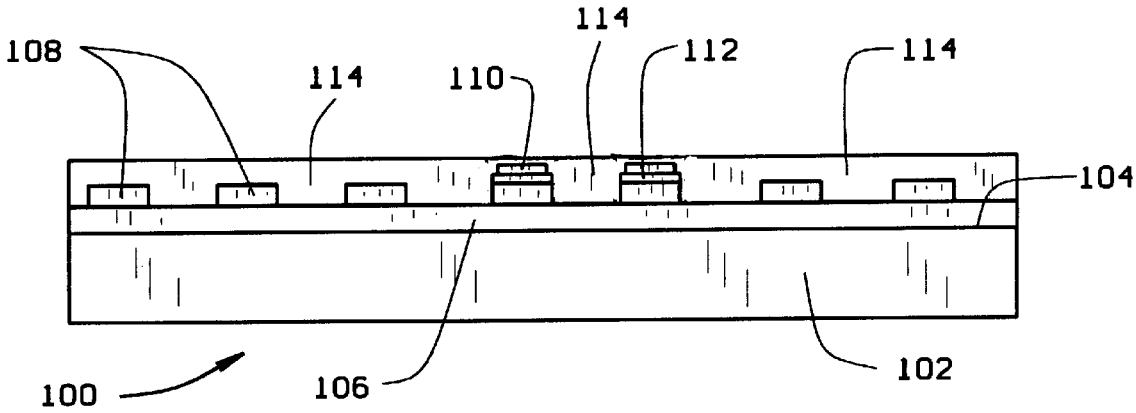
FIG. 1 shows a vertical cross section of the layers of the a luminum substrate heating device.

Referring first to FIG. 1, a vertical cross section of the high CTE metal substrate like aluminum heating device 100 is shown. A high CTE metal (such as aluminum) plate 102 having a flat surface 104 that has been roughened by a method of sandblasting or particle blasting or other appropriate method and that forms the substrate for the heating device. The plate in its preferred embodiment is high purity aluminum but depending on the application an aluminum alloy may be utilized containing elements such as Mg, Si, Cu, or other elements of like properties. Also, other metals having high CTEs above $16\times10E^{-6}/°$ C. may be chosen. The roughened surface makes for better adherence of the dielectric material because of the increased surface area.

A thermally applied (such as plasma sprayed) dielectric layer 106 of ceramic oxide (a ceramic containing an oxidized metal) is applied over the roughened substrate surface. Alumina ($Al_2O_3$) is an example of a ceramic oxide that can be utilized and is considered the preferred embodiment. The alumina prior to introduction into the plasma spray or other thermal application is in the form of $Al_2O_3$ powders which is preferred to have a purity greater than 99% and a particle size within the range between from about 0.1 to 10 $\mu$m and having a mean size within the range between from about 1 to 3 $\mu$m, but these parameters may vary dependent on the application. The thickness of the dielectric coating applied is preferred to be within the range between from about 75 to 250 $\mu$m, but can vary dependent on the application. However, zirconia ($ZrO_2$) is also a ceramic oxide that can be utilized or other ceramic oxides of similar characteristics.

Traditionally the dielectric layer was made of glass or glass ceramics by screen printing followed by a firing process to burn off the organic binder and consolidate and densify the glass dielectric to minimize the porosity. The purpose of minimizing the porosity was to reduce the possibility of insulation breakdown at high temperatures or high voltages. Also, excess porosity may allow the thick film to penetrate through the dielectric layer thereby shorting to the metal substrate. However, as noted in the Related Art section above, the traditional glass or glass based dielectric is not compatible when using a thick film heating element over an aluminum substrate due to the incompatibility of the coefficients of thermal expansion of the aluminum, glass and thick film during burn off or actual operation. The glass or glass based dielectric is prone to crack under such conditions. The key characteristics of the dielectric for adequate performance when applied over aluminum are fracture toughness, coefficient of thermal expansion and melting point. Ceramic oxides that fall within the following range is preferred:

for CTE: $6\times10E^{-6/C}$ to $19\times10E^{-6}/C$ for fracture strength: greater than 100 MPa for melting point: greater than 600° C.

However, these parameters may vary dependant on what aluminum alloy or other high CTE metal that is chosen.

A silk screened metal based paste containing glass, an organic binder and solvent, such as, for example, ESL 590 ink available commercially from the manufacturer ESL, (thick film) heating element circuit pattern 108 is applied over the dielectric layer 106. The heating element is preferred to be made of pure Ag or an Ag/Pd alloy with elements such as glass with a melting temperature of below 600° C. The thick film is dried at a high temperature, approximately 150° C., for approximately 40 minutes to remove the solvent and the thick film is subsequently fired for approximately 10 to 15 minutes at a high temperature approximately 580° C in order to consolidate the thick film and to provide for adequate bonding to the alumina dielectric, The thick film thickness once applied can be in the range from about between the range 5 to 30 $\mu$m and a resistivity in the range of about between 3 mΩ to 1000Ω per square inch. The thick film can be printed over the dielectric by various methods to achieve the desired result such as thermal spraying, laser cading, or direct writing The heating element circuit pattern terminates at terminal foils 110 by bonding the circuit pattern terminals to terminal foils 110 with a bonding agent such as a brazing alloy or a fritted conductive noble metal paste which overlay the termination lead ends of the circuit pattern. The thick film circuit pattern is attached by a brazing alloy bonding agent as a preferred embodiment. An insulative over coat top layer 114 is then applied over the heater element circuit pattern. A preferred over coat material is a ceramic oxide such as alumina ($Al_2O_3$) or zirconia ($ZrO_2$) or another ceramic oxide with comparable thermal and insulation properties. The ceramic oxide over coat is applied by using a plasma spray coating process or other standard application process. The thermal and strength properties of the ceramic oxide over coat is preferably the same as the properties of the ceramic oxide used for the dielectric layer. However, the thickness and surface texture of the dielectric layer and that of the over coat layer may differ.

If an over glaze top layer is chosen, it should be noted that for thick film heaters the insulative top layer 114 is typically glass based. It is typically a silk screened over glaze paste top layer 114 containing glass, an organic binder and solvent (such as, for example, ESL 4771G ink made by ESL) that is applied (thick film over-glaze) over the heater element circuit pattern. The over-glaze is glass based and preferably contains major components such as Si, B, O, Al, Pb, alkaline earth elements (Mg, Ca, Sr, Ba) and alkaline elements (Li, Na, K).

However, if a glass based over glaze is used as an insulative top layer 114, the maximum operating temperature may be limited. As noted above, using a glass based dielectric layer to serve as an insulation between a thick film heating element circuit pattern and an aluminum substrate is problematic. This is because aluminum has a very high coefficient of thermal expansion (CTE), much higher than that of glass. The mismatch in CTE between the glass dielectric layer and a metal substrate having a high CTE causes cracking in the dielectric layer during firing and actual operation.

An analysis of the design, however, suggests that the use of a glass over glaze as an insulative top layer is not as critical as use of a glass dielectric over an aluminum substrate. This is because the glass based top layer is not applied directly to the aluminum substrate. Thus, the change in CTE between the top layer and the adjacent layers (thick film resistive element layer and ceramic oxide dielectric layer) is not as large as that between a glass dielectric and an aluminum substrate. Also, insulation resistance is not as critical as the dielectric layer on the substrate from a leakage point of view. Therefore the expansion shock caused by the aluminum substrate is not transduced directly to the top layer.

In summary, the glass over glaze top layer is applied by a silkscreen process and thus must be fired in order to cure. Thus the firing temperature and the possible high operating temperatures of a heater and the resulting cool down may induce cracking even in the top layer because of the high CTE of an aluminum substrate. Therefore, even though cracking is less likely when a glass based material is used as a top layer as oppose to when it is used as a dielectric layer, a ceramic oxide material as an insulative top layer remains the preferred embodiment.

Figure 2:
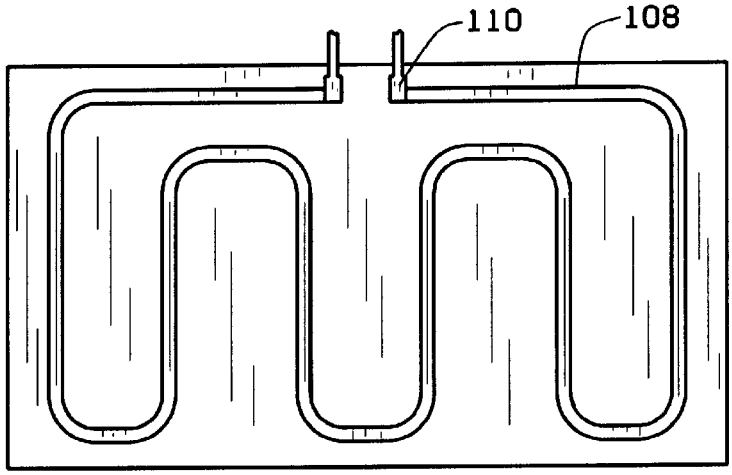
FIG. 2 shows an alternative heater embodiment.
Figure 3:
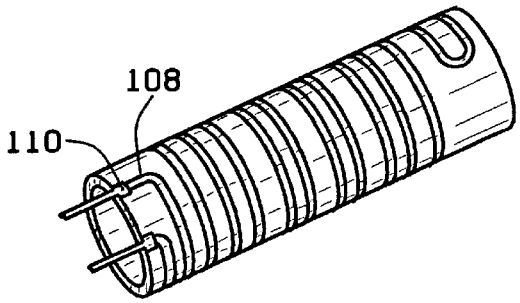
FIG. 3 shows an alternative heater embodiment.

Referencing FIGS. 2 and 3, other heater body and heater element circuit pattern embodiments are shown. In FIG. 2 a circuit pattern is shown applied over a flat substrate. In FIG. 3 a circuit pattern is shown over a tubular substrate. A plurality of other substrate and circuit pattern designs may be implemented. For example, the substrate could have irregular contours and/or the circuit patterns could have irregular continuous traces.

In view of the foregoing, it will be seen that the stated objects of the invention are achieved. The above description explains the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above-described exemplary embodiments, but should be defined only in accordance with the following claims appended hereto and their equivalents.

All patents, if any, referenced herein are incorporated in their entirety for purposes of background information and additional enablement.

What is claimed is:

1. A resistive heater comprising:

a metal substrate having a CTE greater than $16\times10E^{-16}/°$ C.;

a dielectric layer comprised entirely of ceramic oxide, said dielectric layer bonded on said substrate; and a thick film resistive heating element layer bonded over said dielectric layer, with the dielectric layer separating said substrate and said element layer.

2. The resistive element heater of claim 1, wherein said substrate has a surface roughness in the range from about 100 μin. to about 200 μin.

3. The resistive element heater of claim 1, wherein said dielectric layer has a coefficient of thermal expansion within the range of 6×10E /C to $19\times10E^{-6}/C^{-6}$ and a fracture toughness greater than 100 MPa.

4. The resistive element heater of claim 1, wherein said dielectric layer is ceramic oxide powders thermally bonded to the substrate to create a densified layer without requiring post sintering.

5. The resistive element heater of claim 4, wherein the dielectric layer is thermally bonded by plasma spraying.

6. The resistive element heater of claim 4, wherein said ceramic oxide powders are sized in a range from about between 0.1 to 10 μm.

7. The resistive element heater of claim 6, wherein the ceramic oxide is Zirconia ($ZrO_2$).

8. The resistive element heater of claim 6, wherein the ceramic oxide is Alumina ($Al_2O_3$).

9. The resistive element heater of claim 1, where said thick film resistive layer is a noble metal containing glass.

10. The resistive element heater of claim 9, where said noble metal is silver.

11. The resistive element heater of claim 1, further comprising a glass based over-glaze bonded over said resistive layer.

12. The resistive element heater of claim 1, further comprising:

a ceramic oxide based over-coat wherein said over-coat is a thermally bonded layer applied over said resistive layer.

13. The resistive element of claim 12, wherein the over-coat is thermally bonded by plasma spraying.

14. The resistive heater element of claim 1, wherein the metal substrate is aluminum.

15. A resistive element heater comprising:

a substrate of metal with a CTE greater than $16\times10E^{-16}/°$ C. having a roughened surface created by roughening a surface of a piece of metal stock having a CTE greater than $16\times10E^{-16}/°$ C.;

a dielectric layer comprised entirely of ceramic oxide deposited on the roughened substrate by thermal bonding; and a resistive layer deposited on the dielectric layer by printing a noble metal paste containing an organic binder and solvent over said dielectric layer.

16. The resistive element heater of claim 15, further comprising:

an over-glaze layer deposited over the resistive layer by printing a glass based over-glaze paste containing an organic binder and solvent over said resistive layer.

17. The resistive element heater of claim 15, further comprising:

an over-coat layer deposited over the resistive layer by thermally bonding a ceramic oxide based over coat over said resistive layer.

18. The resistive element heater of claim 17, wherein said ceramic oxide is alumina ($Al_2O_3$).

19. The resistive element heater of claim 17, wherein said ceramic oxide is zirconia ($ZrO_2$).

* * * * *